US010543962B2

(12) United States Patent
Byrd et al.

(10) Patent No.: US 10,543,962 B2
(45) Date of Patent: Jan. 28, 2020

(54) CONTAINER AND CAP ASSEMBLY

(71) Applicant: ELC MANAGEMENT LLC, Melville, NY (US)

(72) Inventors: Richard L. Byrd, Fountain Inn, SC (US); Michael Lyons, Redding, CT (US)

(73) Assignee: ELC MANAGEMENT LLC, Melville, NY (US)

( * ) Notice: Subject to any disclaimer, the term of this patent is extended or adjusted under 35 U.S.C. 154(b) by 0 days.

(21) Appl. No.: 15/631,147

(22) Filed: Jun. 23, 2017

(65) Prior Publication Data

US 2018/0370691 A1 Dec. 27, 2018

(51) Int. Cl.

| | |
|---|---|
| ***B65D 41/04*** | (2006.01) |
| ***B65D 41/34*** | (2006.01) |
| ***B65D 41/18*** | (2006.01) |
| ***B65D 1/02*** | (2006.01) |
| *B65D 41/00* | (2006.01) |

(52) U.S. Cl.

CPC ..... *B65D 41/0421* (2013.01); *B65D 1/023* (2013.01); *B65D 41/0471* (2013.01); *B65D 41/0492* (2013.01); *B65D 41/18* (2013.01); *B65D 41/34* (2013.01); *B65D 1/02* (2013.01); *B65D 41/00* (2013.01)

(58) Field of Classification Search

CPC ..... B65D 41/0421; B65D 41/0414; B65D 41/0407; B65D 41/04; B65D 41/0478; B65D 41/0471; B65D 41/34; B65D 41/3404; B65D 41/00; B65D 1/023; B65D 1/0246; B65D 1/0223; B65D 1/02; B65D 51/24; B65D 51/18

USPC ... 215/318, 317, 223, 316, 228, 329, 44, 43, 215/222, 217; 220/212, 254.8, 254.1, 220/259.4, 259.3, 256.1; 222/153.1

See application file for complete search history.

(56) References Cited

U.S. PATENT DOCUMENTS

| | | | | |
|---|---|---|---|---|
| 3,064,844 | A | 11/1962 | Hoffmann | |
| 3,124,273 | A * | 3/1964 | Remington et al. ... | B65D 41/08 215/386 |
| 3,630,403 | A | 12/1971 | Berg | |
| 6,182,822 | B1 | 2/2001 | Albisetti | |
| 6,394,295 | B2 | 5/2002 | Claude | |
| 7,028,858 | B2 | 4/2006 | Auer et al. | |

(Continued)

FOREIGN PATENT DOCUMENTS

| | | |
|---|---|---|
| CN | 103057826 | 4/2013 |
| CN | 202935716 | 5/2013 |

(Continued)

OTHER PUBLICATIONS

PCT/UC2017/026553 International Search Report of corresponding PCT application.

(Continued)

*Primary Examiner* — Robert J Hicks

(74) *Attorney, Agent, or Firm* — Martin Haerter; Peter Giancana

(57) ABSTRACT

A cap assembly for a container has an inner sleeve that is secured to the neck of the container and an outer cap that is adjustably secured to the inner sleeve. The outer cap can be adjusted downwardly relative to the inner sleeve so that a gap between the bottom of the outer cap and a top of the container can be minimized or eliminated.

9 Claims, 6 Drawing Sheets

(56) References Cited

U.S. PATENT DOCUMENTS

| | | | | |
|---|---|---|---|---|
| 8,365,933 | B2 | 2/2013 | Jackel | |
| 8,403,008 | B2 * | 3/2013 | Bouix | A45D 34/04 141/23 |
| 9,254,947 | B2 | 2/2016 | Tada et al. | |
| 9,617,043 | B2 | 4/2017 | McGirr et al. | |
| 2012/0055945 | A1 | 3/2012 | Muhlhausen et al. | |
| 2013/0214004 | A1 * | 8/2013 | Dejonge | B65D 50/061 222/153.11 |
| 2016/0176590 | A1 | 6/2016 | Prater et al. | |
| 2017/0066565 | A1 | 3/2017 | Park | |

FOREIGN PATENT DOCUMENTS

| | | |
|---|---|---|
| CN | 203047756 | 7/2013 |
| CN | 203234215 | 10/2013 |
| CN | 103434741 A | 12/2013 |
| CN | 203568124 U | 4/2014 |
| CN | 104609013 | 5/2015 |
| CN | 103449006 | 8/2015 |
| CN | 205470560 | 8/2016 |
| CN | 205819899 | 12/2016 |
| DE | 102008017468 | 8/2015 |
| FR | 2781133 | 1/2000 |
| JP | 2010-095259 A | 4/2010 |
| JP | 4899209 | 3/2012 |
| JP | 2013-95486 | 5/2013 |
| JP | 5560395 | 7/2014 |
| JP | 2015-48122 | 3/2015 |
| JP | 5966240 | 8/2016 |
| JP | 5975384 | 8/2016 |
| JP | 2016-179862 | 10/2016 |
| WO | WO-2009121582 | 10/2009 |
| WO | WO-2017/108697 | 6/2017 |

OTHER PUBLICATIONS

PCT/UC2017/026553 Written Opinion of the International Search Authority of corresponding PCT application.

* cited by examiner

CONTAINER AND CAP ASSEMBLY

BACKGROUND OF THE INVENTION

Field of the Invention

The present invention relates to containers with pull off, snap-fit or threaded caps. In particular, the present invention is directed to a container with a cap having inner and outer components to allow adjustment of the outer component relative to the container for aesthetic purposes.

Description of the Prior Art

The shapes of cap and container combinations may be selected to be sleek, with aesthetic considerations often taking precedent over functional aspects. Surfaces are smooth and gaps between container and cap are preferably minimized to provide a near seamless appearance that is more luxurious, sculpted and appealing to consumers. Making and using such designs can yield challenges. For example, achieving the close fit of components can be challenging due to differences in manufacturing tolerances for such materials as plastic and glass. Containers made of glass have may have significantly larger variance in specifications than do plastic components due to mold and material tolerance considerations. Accordingly, when a cap assembly made of plastic is installed on a glass container, it can be difficult to achieve a close, snug fit of the components.

Accordingly, there is a need for a container and cap combination that allows for a close fit of components during assembly.

BRIEF SUMMARY OF THE INVENTION

It is an object of the invention to provide a container and cap combination that assembles easily with close tolerances between components of different materials.

To overcome the problems of the prior art and achieve the objects of the invention, a cap assembly is provided with inner and outer components that are adjustable with respect to each other during the assembly on the container. The inner component is installed on the container first. The outer component is then pushed onto the inner component on the container until a minimum gap is achieved between the bottom of the outer component and the top surface or shoulder of the container.

The invention allows the outer cap to be positioned on the container in a snug manner wherein the bottom of the outer cap always comes in close proximity to the shoulder of the container. In this way any potential esthetic or functional gap between cap assembly and the container is minimized or eliminated.

DETAILED DESCRIPTION OF THE INVENTION

Figure 1:
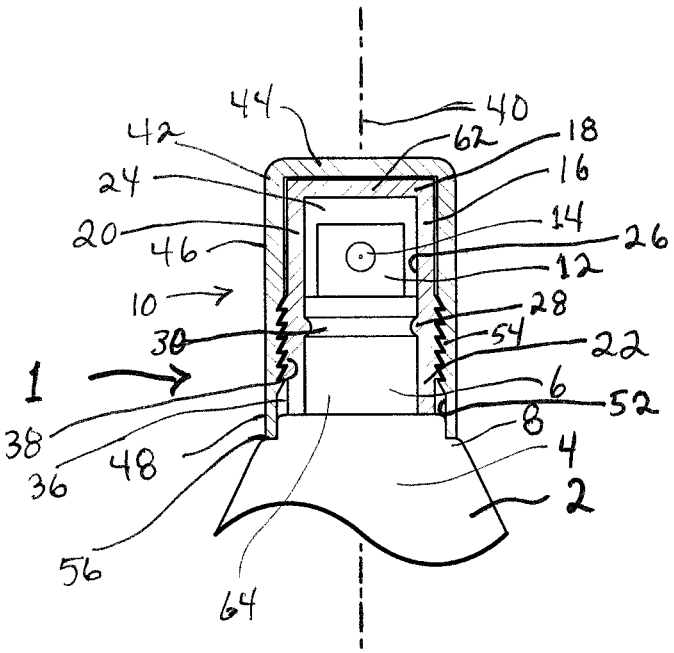
FIG. 1 is a front elevation, partial sectional view of a combined container and cap assembly of the present invention.
Figure 2:
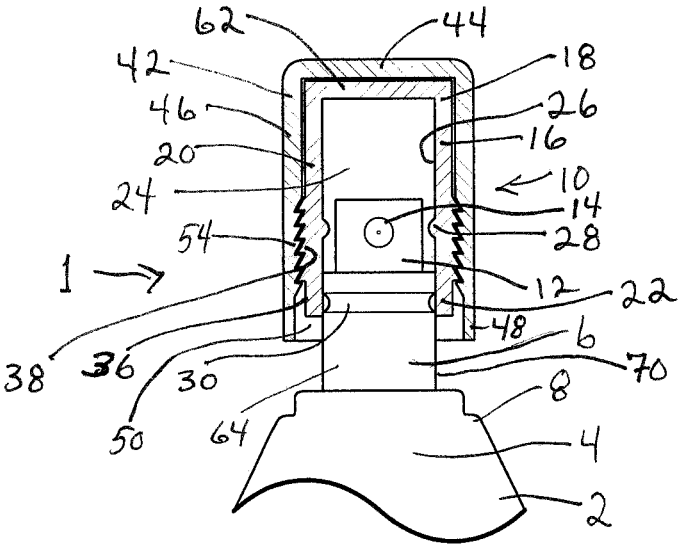
FIG. 2 is a front elevation, partial sectional view of the combined container and cap assembly shown in FIG. 1 with the cap assembly partially removed from the container.
Figure 3:
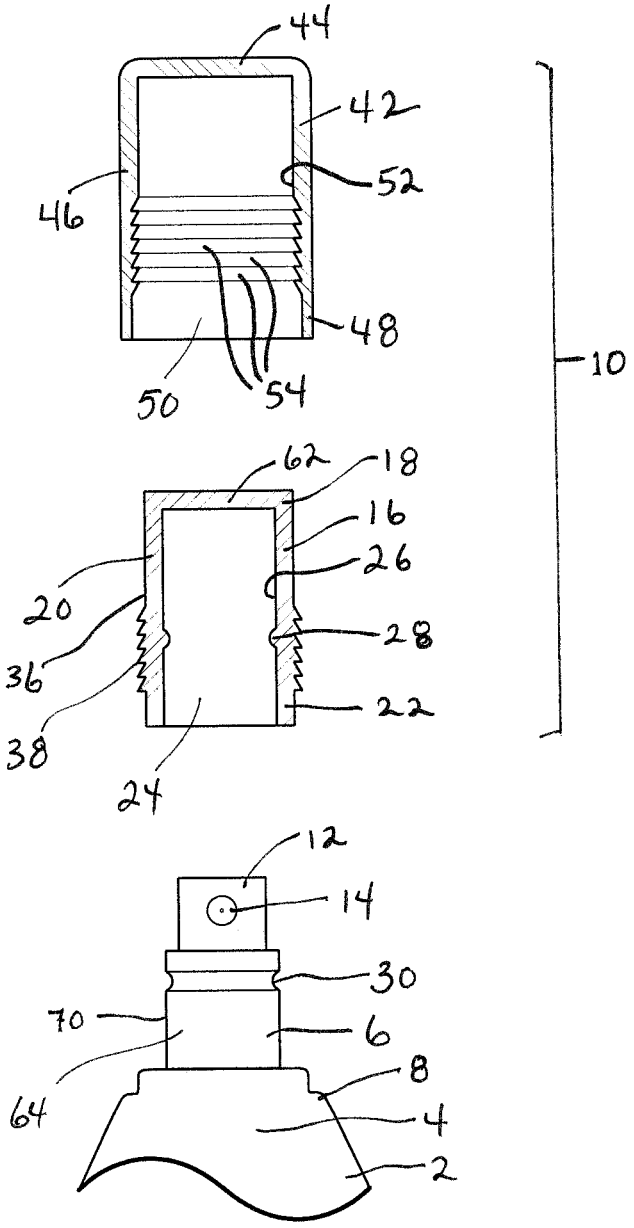
FIG. 3 is an exploded view of the combined container and cap assembly of FIG. 1.

Referring now to FIGS. 1-3, a first embodiment of a combined container and cap assembly, shown generally at reference number 1, comprises a container 2 having body 4 with a neck 6 extending upwardly from the body 4. The neck 6 is narrower than the body 4 such that at least one shoulder 8 is defined below the neck 6. The container 2 may have a dispensing button 12 with a nozzle 14 for dispensing product from the container 2.

A cap assembly 10 is provided for closing off the neck 6. The cap assembly has an inner sleeve 16 with an upper end 18 and a depending circumferential sidewall 20 extending to a lower end 22. The sidewall 20 defines a cavity 24 opening downwardly. The cavity 24 is dimensioned to receive the neck 6 of the container 2. An inside surface 26 of the sidewall 18 is adapted to selectively and removably secure the inner sleeve 16 on the neck 6 of the container 2. The inside surface 26 may have a snap bead 28 to selectively and cooperatively engage a snap groove 30 on the outwardly directed surface 70 of the neck 6. Alternatively, the snap bead may be on the neck and the snap groove may be on the inner sleeve. The neck and inner sleeve may alternatively be engaged by way of respective internal threads and external threads (as described below and shown in FIGS. 4-6).

An outer surface 36 of the inner sleeve 16 has an array of ratchet teeth 38 arranged from the upper end 18 to the lower end 20. Each of the ratchet teeth in the array are positioned transversely relative to a vertical axis 40 through the cap assembly 10.

An outer cap 42 is secured to the inner sleeve 16. The outer cap 42 has a top end wall 44 and a circumferential skirt wall 46 depending from the top end wall 44 to a bottom end 48. The skirt wall defines a void 50 opening downwardly and dimensioned to receive the inner sleeve 16. An interior surface 52 of the skirt wall has at least one pawl 54 adapted to engage the array of ratchet teeth 38 as the outer cap 42 is pushed into final position on the inner sleeve 16. The outer cap 42 is downwardly positionable along the array of ratchet teeth 38 such that a gap 56 between the bottom end 48 of the skirt wall 46 and the shoulder 8 of the container 2 is substantially minimized or closed.

A horizontal wall 62 may be provided at the upper end 18 of the inner sleeve 16 to close off the inner sleeve and form an inner cap.

Figure 4:
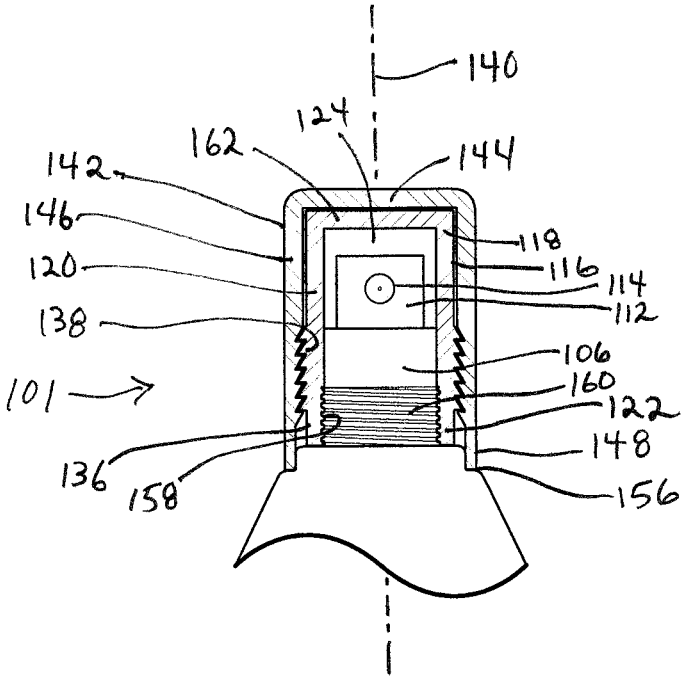
FIG. 4 is a front elevation, partial sectional view of a second embodiment of the combined container and cap assembly.
Figure 5:
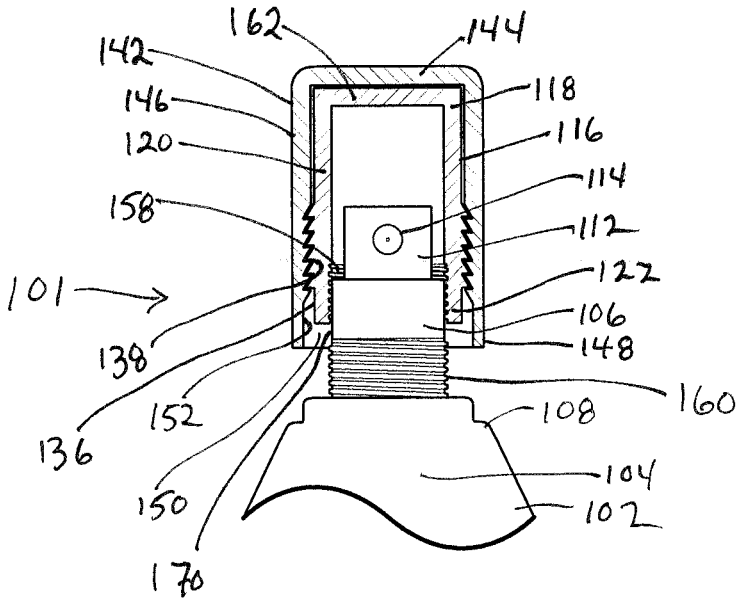
FIG. 5 is a front elevation, partial sectional view of the combined container and cap assembly shown in FIG. 4 with the cap assembly partially removed from the container.
Figure 6:
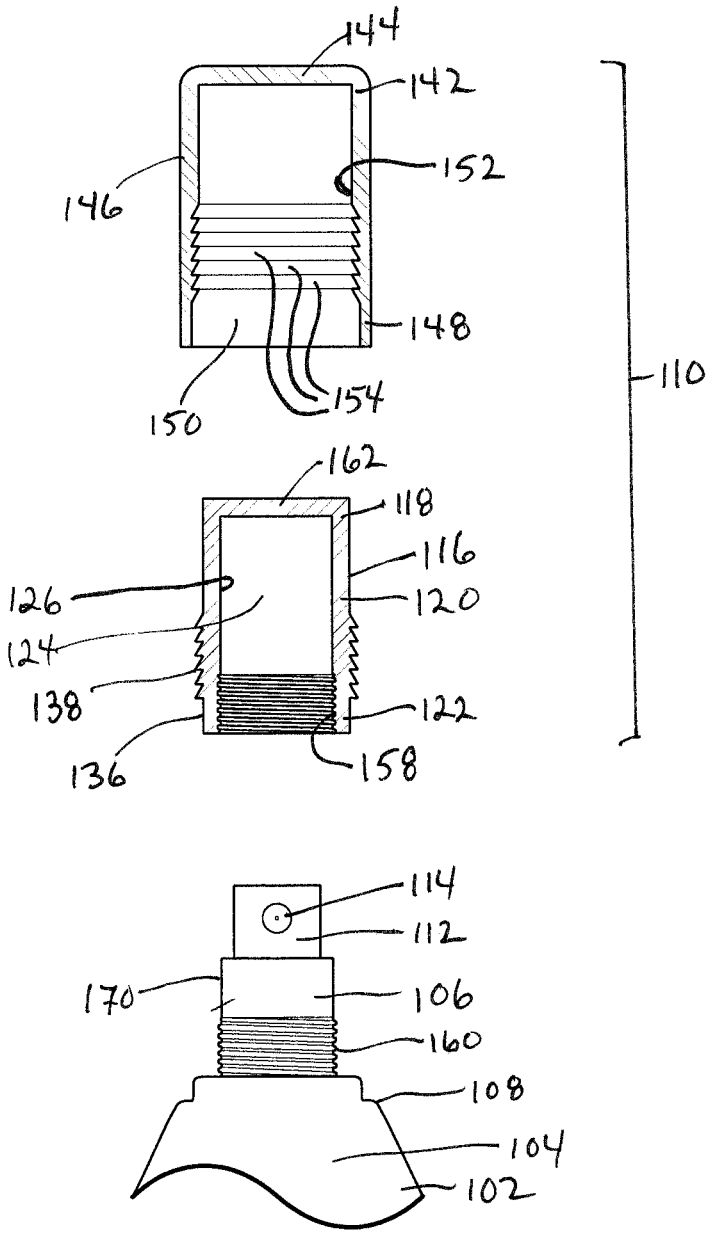
FIG. 6 is an exploded view of the combined container and cap assembly of FIG. 4.

As noted above, the neck 6 of the container 2 is received in the cavity 24 of the inner sleeve 16 by one of sliding interference fit engagement, snap-fit engagement (FIGS. 1-3 and 7-9) or screw thread engagement (FIGS. 4-6).

A collar 64 may be secured on the neck 6 between the neck 6 and the inner sleeve 16.

In this first embodiment, the outer surface 36 of the inner sleeve is located directly on the sidewall 20.

The cap assembly may be installed on the neck of the container in at least two different ways. In a first approach, the inner sleeve is installed on the neck and subsequently, the outer cap is installed on the inner sleeve and adjusted to the appropriate position of the bottom of the outer cap relative to the shoulder of the container. Alternatively and preferably, the outer cap is temporarily installed at a first elevated temporary position on the inner sleeve. After the outer cap is in the first elevated temporary position on the inner sleeve, the cap assembly (outer cap plus inner sleeve) is installed on the container neck. After the inner sleeve is secured to the neck by sliding, snap-fit or threaded engagement, the outer cap can be adjusted downwardly to a second lower final position on the inner sleeve such that the gap between the bottom of the outer cap and the container shoulder is minimized or closed.

Referring now to FIGS. 4-6, a second embodiment of a combined container and cap assembly, shown generally at reference number 101, comprises a container 102 having body 104 with a neck 106 extending upwardly from the body 104. The neck 106 is narrower than the body 104 such that at least one shoulder 108 is defined below the neck 106. The container 102 may have a dispensing button 112 with a nozzle 114 for dispensing product from the container 102.

A cap assembly 110 is provided for closing off the neck 106. The cap assembly has an inner sleeve 116 with an upper end 118 and a depending circumferential sidewall 120 extending to a lower end 122. The sidewall 120 defines a cavity 124 opening downwardly. The cavity 124 is dimensioned to receive the neck 106 of the container 102. An inside surface 126 of the sidewall 118 is adapted to selectively and removably secure the inner sleeve 116 on the neck 106 of the container 102. The inside surface 126 has internal threads 158 to selectively and cooperatively engage external threads 160 on the outwardly directed surface 170 of the neck 106.

An outer surface 136 of the inner sleeve 116 has an array of ratchet teeth 138 arranged from the upper end 118 to the lower end 120. Each of the ratchet teeth in the array are positioned transversely relative to a vertical axis 140 through the cap assembly 110.

An outer cap 142 is secured to the inner sleeve 116. The outer cap 142 has a top end wall 144 and a circumferential skirt wall 146 depending from the top end wall 144 to a bottom end 148. The skirt wall defines a void 150 opening downwardly and dimensioned to receive the inner sleeve 116. An interior surface 152 of the skirt wall has at least one pawl 154 adapted to engage the array of ratchet teeth 138 as the outer cap 142 is pushed into final position on the inner sleeve 116. The outer cap 142 is downwardly positionable along the array of ratchet teeth 138 such that a gap 156 between the bottom end 148 of the skirt wall 146 and the shoulder 108 of the container 102 is substantially minimized or closed.

A horizontal wall 162 may be provided at the upper end 118 of the inner sleeve 116 to close off the inner sleeve and form an inner cap.

As noted above, the neck 106 of the container 102 is received in the cavity 124 of the inner sleeve 116 by one of sliding interference fit engagement, snap-fit engagement (FIGS. 1-3 and 7-9) or screw thread engagement (FIGS. 4-6).

In this second embodiment, the outer surface 136 of the inner sleeve is located directly on the sidewall 120.

Figure 7:
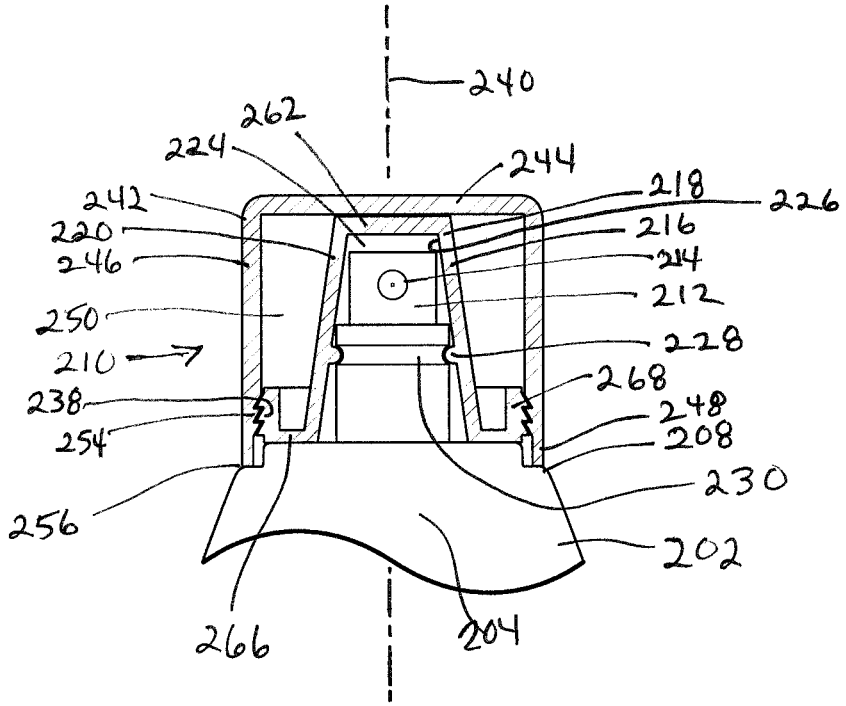
FIG. 7 is a front elevation, partial sectional view of a third embodiment of the combined container and cap assembly.
Figure 8:
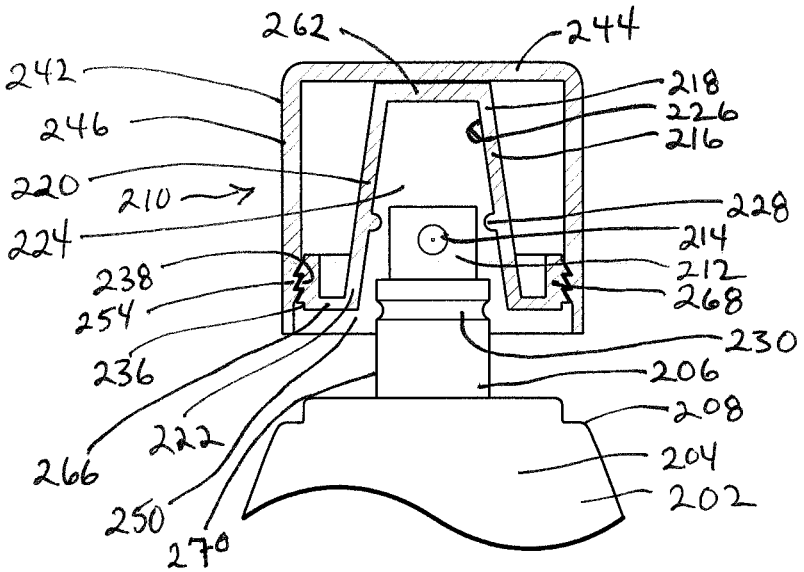
FIG. 8 is a front elevation, partial sectional view of the combined container and cap assembly shown in FIG. 7 with the cap assembly partially removed from the container.
Figure 9:
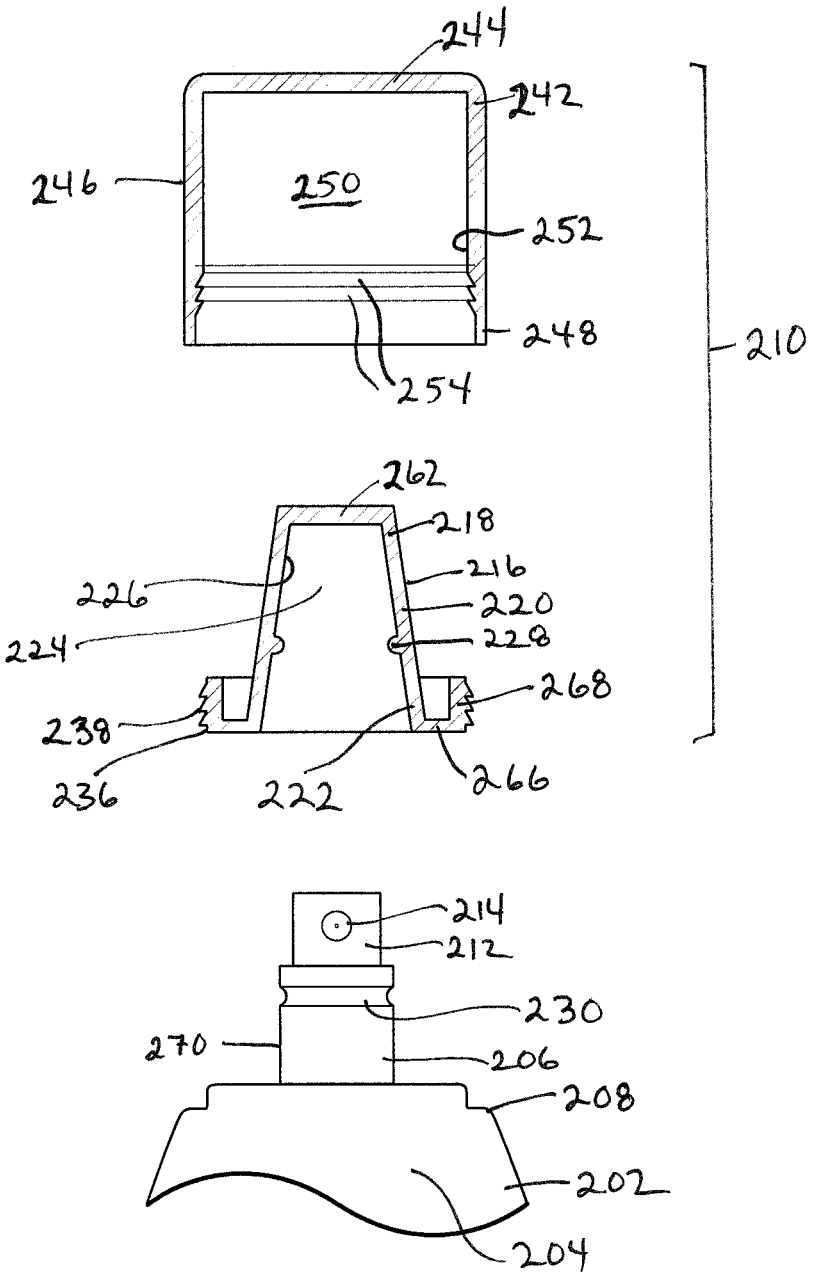
FIG. 9 is an exploded view of the combined container and cap assembly of FIG. 7.

Referring now to FIGS. 7-9, a third embodiment of a combined container and cap assembly, shown generally at reference number 210, comprises a container 202 having body 204 with a neck 206 extending upwardly from the body 204. The neck 206 is narrower than the body 204 such that at least one shoulder 208 is defined below the neck 206. The container 202 may have a dispensing button 212 with a nozzle 214 for dispensing product from the container 202.

A cap assembly 210 is provided for closing off the neck 206. The cap assembly has an inner sleeve 216 with an upper end 218 and a depending circumferential sidewall 220 extending to a lower end 222. The sidewall 220 defines a cavity 224 opening downwardly. The cavity 224 is dimensioned to receive the neck 206 of the container 202. An inside surface 226 of the sidewall 218 is adapted to selectively and removably secure the inner sleeve 216 on the neck 206 of the container 202. The inside surface 226 has a snap bead 228 to selectively and cooperatively engage a snap groove 230 on the outwardly directed surface 270 of the neck 206. Alternatively, the snap bead may be on the neck and the snap groove may be on the inner sleeve.

An outer surface 236 of the inner sleeve 216 has an array of ratchet teeth positioned transversely relative to a vertical axis 240 through the cap assembly 210.

An outer cap 242 is secured to the inner sleeve 216. The outer cap 242 has a top end wall 244 and a circumferential skirt wall 246 depending from the top end wall 244 to a bottom end 248. The skirt wall defines a void 250 opening downwardly and dimensioned to receive the inner sleeve 216. An interior surface 252 of the skirt wall has at least one pawl 254 adapted to engage the array of ratchet teeth 238 as the outer cap 242 is pushed into final position on the inner sleeve 216. The outer cap 242 is downwardly positionable along the array of ratchet teeth 238 such that a gap 256 between the bottom end 248 of the skirt wall 246 and the shoulder 208 of the container 202 is substantially minimized or closed.

A horizontal wall 262 may be provided at the upper end 218 of the inner sleeve 216 to close off the inner sleeve and form an inner cap.

As noted above, the neck 206 of the container 202 is received in the cavity 224 of the inner sleeve 216 by one of sliding interference fit engagement, snap-fit engagement or screw thread engagement (similar to the second embodiment shown in FIGS. 4-6).

In this third embodiment, the inner sleeve 216 further comprises a horizontal radial wall 266 extending radially outwardly from the sidewall 220, and a vertically oriented circumferential secondary wall 268. In this third embodiment, the outer surface 236 of the inner sleeve 216 is an outwardly directed surface of the secondary wall 268. The array of ratchet teeth 238 are positioned on the secondary wall.

The container 2, 102, 202 may be made of any suitable material, such as, for example, glass, metal or plastic. The collar 64, 164, 264 and cap assembly 10, 110, 210 components may be made of a suitable plastic material such as, for example, poly propylene, acrylonitrile butadiene styrene, or other suitable material. Preferably, the inner cap assembly components are made of a relatively softer plastic material and the outer components are made of a relatively more rigid plastic material.

The ratchet and pawl assembly preferably operates in one direction only (similar to a "Zip Tie"). While the outer cap can be adjusted downwardly with respect to the inner sleeve to close the gap between the cap assembly and the container, to prevent the outer cap from dislodging or separating from the inner sleeve, the outer cap is not adjusted upwardly on the ratchet array with respect to the inner sleeve.

The advantages of the present invention are that the ratcheting cap assembly components allows the outer cap to adjust to closer tolerances of mating components. Unsightly gaps are reduced, minimized and may even be eliminates. No adhesives are required. The assembly may be used with either round or square cross-section containers.

It is understood that various modifications and changes in the specific form and construction of the various parts can be made without departing from the scope of the following claims.

What is claimed is:

1. A container and cap assembly comprising:

a container having a body with a neck extending upwardly from the container, the neck having a radially outwardly directed surface, and the neck narrower than the body such that a shoulder is defined below the neck, a cap assembly comprising:

an inner sleeve having an upper end and a depending circumferential sidewall extending to a lower end, the sidewall defining a cavity opening downwardly, the cavity dimensioned to receive the neck of the container, an inside surface of the sidewall adapted to secure the inner sleeve on an outwardly directed surface of the neck of the container, and an outer surface of the inner sleeve having an array of ratchet teeth arranged from the upper end to the lower end, each of the ratchet teeth positioned transversely relative to a vertical axis through the cap assembly; and an outer cap secured to the inner sleeve, the outer cap having a top end wall and a circumferential skirt wall depending from the top end wall to a bottom end, the skirt wall defining a void opening downwardly and dimensioned to receive the inner sleeve, an interior surface of the skirt wall having at least one pawl adapted to engage the array of ratchet teeth as the outer cap is pushed into final position on the inner sleeve, the outer cap downwardly positionable along the array of ratchet teeth such that when the outer cap reaches the final position on the inner sleeve, then a gap between the bottom end of the skirt wall and the shoulder of the container is substantially minimized or closed, and the outer cap cannot be adjusted upwardly with respect to the inner sleeve.

2. The container and cap assembly of claim 1 further comprising a horizontal wall closing off the upper end of the inner sleeve.

3. The container and cap assembly of claim 1 wherein the neck of the container is received in the cavity of the inner sleeve by one of sliding interference fit engagement, snap-fit engagement and screw thread engagement.

4. The container and cap assembly of claim 1 further comprising a collar secured on the neck of the container between the neck and the inner sleeve.

5. The container and cap assembly of claim 1 wherein the outer surface of the inner sleeve is the surface of the sidewall.

6. The container and cap assembly of claim 1 wherein the inner sleeve further comprises a horizontal radial wall and a vertically oriented circumferential secondary wall, and wherein the outer surface of the inner sleeve is an outwardly directed surface of the secondary wall, and the array of ratchet teeth are positioned on the secondary wall.

7. The container and cap assembly of claim 1 further comprising a snap bead on one of the inner surface of the inner sleeve and the outwardly directed surface of the neck, and a cooperatively engaging snap groove on the other of the inner surface of the inner sleeve and the outwardly directed surface of the neck.

8. The container and cap assembly of claim 1 further comprising internal screw threads on the inner surface of the inner sleeve and a cooperatively engaging external screw threads on the outwardly directed surface of the neck.

9. A cap assembly for a container, the container having a neck with a circumferential snap groove, the container further having a shoulder below the neck, the cap assembly comprising:

a vertical inner sleeve having an inner surface and an outer surface and an upper end and a lower end, the inner sleeve dimensioned to fit closely around the neck, the inner surface having a snap bead dimensioned to be selectively received in snap-fit engagement in the snap groove on the neck; and an outer cap comprising a top end wall and a circumferential skirt wall depending from the top end wall, the skirt wall having an interior surface and a bottom end, the skirt wall dimensioned to be closely received around the inner sleeve;

wherein at least one of the outer surface of the inner sleeve or the interior surface of the skirt wall has a vertical array of ratchet teeth and the other of the outer surface of the inner sleeve or the interior surface of the skirt wall has at least one pawl tooth; and wherein, prior to snap-fit installation of the cap assembly on the neck of the container, the outer cap is initially secured on the inner sleeve in a first elevated position by the at least one pawl tooth engaging the array of ratchet teeth at an upper portion of the array, and, after installation of the cap assembly on the neck by way of the snap bead being received in snap-fit engagement in the snap groove on the neck, the outer cap is downwardly movable and securable to a second lower position on the inner sleeve by the at least one pawl tooth engaging the array of ratchet teeth at a lower portion of the array such that when the outer cap reaches the second lower position on the inner sleeve, then a gap measured vertically between the bottom end of the skirt wall of the outer cap and the shoulder of the container is substantially closed, and the outer cap cannot be adjusted upwardly with respect to the inner sleeve.

* * * * *